United States Patent [19]

Schedele

[11] Patent Number: 4,602,230

[45] Date of Patent: Jul. 22, 1986

[54] POLARIZED ELECTROMAGNETIC RELAY

[75] Inventor: Helmut Schedele, Diessen, Fed. Rep. of Germany

[73] Assignee: Siemens Aktiengesellschaft, Berlin & Munich, Fed. Rep. of Germany

[21] Appl. No.: 684,289

[22] Filed: Dec. 20, 1984

[30] Foreign Application Priority Data

Dec. 30, 1983 [DE] Fed. Rep. of Germany ..... 3347602

[51] Int. Cl.[4] ..... H01H 51/22

[52] U.S. Cl. ..... 335/79; 335/81

[58] Field of Search ..... 335/78, 819, 79, 229, 335/230, 276

[56] References Cited

U.S. PATENT DOCUMENTS

| | | | |
|---|---|---|---|
| 2,559,399 | 7/1951 | Carpenter | 335/230 |
| 3,246,211 | 4/1966 | Sauer | 335/276 |
| 4,509,025 | 4/1985 | Kimpel et al. | 335/79 |

FOREIGN PATENT DOCUMENTS

| | | |
|---|---|---|
| 0062332 | 10/1982 | European Pat. Off. . |
| 1292749 | 4/1969 | Fed. Rep. of Germany . |
| 3138265 | 4/1983 | Fed. Rep. of Germany . |
| 2111752 | 7/1983 | United Kingdom . |

*Primary Examiner*—L. T. Hix
*Assistant Examiner*—Brian W. Brown
*Attorney, Agent, or Firm*—Hill, Van Santen, Steadman & Simpson

[57] ABSTRACT

An improved polarized relay characterized by a coil body being received in a recess of a base body along with a permanent magnet arrangement which has a pair of pole plates extending in a common plane with portions bent to form an air gap for receiving a free end of an armature, a flux plate extending perpendicular to the axis of the coil and having a recess to mount the armature and segments extending parallel to the pole plates to form spaces for receiving at least one permanent magnet with the recess being entirely closed by a protective covering so that the only exposure of the magnet arrangement and coil to the contacts is through an opening in which the armature extends to actuate the movable contact element. The polarized relay due to the insulation of the magnet arrangement and the coil is particularly adapted for contacts handling high currents at high ambient temperatures.

20 Claims, 10 Drawing Figures

POLARIZED ELECTROMAGNETIC RELAY

BACKGROUND OF THE INVENTION

The present invention is directed to a polarized magnetic relay having a base body; a coil being secured in the base body and having a coil body with an axially extending passage, a first end flange, a second end flange and a winding on the coil between the flanges; a bar-shaped armature being received inside of the passage of the coil body on an axis thereof with one end being pivotally mounted adjacent the first flange so that the armature can pivotably move in the coil body, a permanent magnet arrangement having two pole plates which are on a common plane extending parallel to the coil axis, each pole plate adjacent the second flange having end portions extending at right angles to the common plane to provide spaced surfaces forming an air gap therebetween with a free end of the armature extending therethrough, said magnet arrangement including a flux plate having a portion extending perpendicular to the coil axis and having at least one segment extending parallel to the pole plates and coacting with the pole plates to form a space for receiving each magnet of the arrangement; at least one stationary contact element anchored in the base body and at least one movable contact element being moved by the armature between a position out of engagement with the associated stationary contact and a position engaging the stationary contact.

A relay of the above known type is disclosed in U.S. patent application Ser. No. 401,235, filed July 23, 1982, which application was based on German Letters Patent No. 31 32 244. The disclosure of this copending application was issued on April 2, 1985 as U.S. Pat. No. 4,509,025 and is incorporated by reference thereto. As disclosed in this patent application, the relay system is very sensitive and has a particular advantage that both a monostable as well as a bistable switching characteristic can be achieved without structural modifications by means of corresponding adaptation of the quadripole permanent magnet system whereby a response value can be obtained in a very tight tolerance range.

The system described in the patent application is particularly suited for very small relays having more than one changeover contact so that a very compact structure is possible. The arrangement of the quadripole permanent magnet over the coil given simultaneous coverage of the contact elements by the pole plates or, respectively, yokes, is very meaningful to design this relay for a compact structure. This design, however, involves problems when such a system is to be utilized for switching high currents because an insulating path required between the contact elements and the magnet system necessitates additional measures. Further, without increasing the overall height, the flat magnet arrangement employed therein can be practically executed only with a ceramic magnet whose response to temperatures will lead to a great reduction of the contact force given uses under high ambient temperatures.

SUMMARY OF THE INVENTION

The present invention is directed to providing a modified and perfected polarized magnetic relay of the type initially cited which relay retains the advantageous properties of the known magnet system in such a fashion that particularly high contact forces for switching high currents can also be achieved given a high ambient temperature. In addition, the relay structure is a simple assembly that has a compact format and simultaneously provides large insulating paths between the magnet system and the contact elements.

To accomplish these goals, the present invention is directed to an improvement in a polarized magnetic relay having a base body; a coil being secured in the base body and having a coil body with an axially extending passage, a first end flange, a second end flange and a winding on the coil body between the flanges; a bar-shaped armature being received inside of the passage of the coil body on an axis thereof with one end of the armature being pivotably mounted adjacent the first flange; a permanent magnet arrangement having two pole plates which are on a common plane extending parallel to the coil axis, each pole plate adjacent the second flange having an end portion extending at right angles to the common plane to provide spaced surfaces with an air gap therebetween for a free end of the armature to extend into said magnet arrangement including a flux plate having a portion extending perpendicular to the coil axis and having a segment extending parallel to the pole plates and coacting with the pole plates to form a space for receiving each magnet of the arrangement; at least one stationary contact element anchored in the base body; and at least one movable contact being moved by the armature between a position out of engagement with the associated stationary contact and a position engaging the stationary contact. The improvements comprise the magnet arrangement having a portion on both sides of the coil, each portion of the arrangement including one pole piece and a narrow segment of the flux plate extending parallel thereto to form a space for receiving a double pole permanent magnet, at least one permanent magnet being provided in one of the two spaces, said one end of the armature being mounted for pivotal movement in a recess in the portion of the flux plate, actuating means for transferring movement of the armature to the movable contact element and wherein said base body having recesses for receiving each of the parts of the relay including the coil body, the contact elements, said flux plate, each permanent magnet and the two pole plates so that during assembly of the relay, the elements, body, plates and magnets are easily plugged into the base body.

Given the inventive relay, the magnetic circuit is improved on the one hand in that the armature is seated directly in the flux plate so that the air gap between the magnet and parts is reduced to a minimum. High contact forces for high-voltage current contacts can thereby be achieved. On the other hand, the magnet system or arrangement is structurally modified over the known magnet system in such a fashion that the permanent magnet arrangement is displaced into the base body at both sides of the coil so as to enable a plug-type fastening of the individual parts into the base body to facilitate a good insulation by means of corresponding design of the base body and therefore a compact overall design of the relay becomes possible.

A permanent magnet arrangement has hereby been subdivided into two parts at both sides of the coil. A relatively great magnet length is thus respectively available for the two permanent magnets next to the coil. Thus, alnico magnets (magnets of aluminum-nickel-cobalt alloys) can be employed. These types of magnets, in fact, require a greater length in the polarization direction than the ceramic magnets but are significantly less temperature-dependent. A relay therefore still retains high contact forces even given utilization under high ambient temperature on the order of 125° C. The pole plates are indeed disposed in the same manner as in the known system and angled down and inwardly toward the armature. However, differing therefrom, the two permanent magnets are not disposed at the outside of the pole plate or yokes as seen from the coil but at the side facing the coil so that the coil lies between two stratas of pole plates, permanent magnets and flux plate sections.

The two permanent magnets, which are polarized in mutually opposite directions, can be balanced independently of one another so that both a bistable switching behavior as well as a monostable switching behavior—as a result of asymmetrical balancing—can be achieved. Also, it is conceivable in a specific embodiment wherein the permanent magnets at one side of the coil is completely demagnetized or is omitted altogether. In this case, the space between the pole plate and the flux plate section can be ferromagnetically bridged or connected so that the relay is lent a monostable switching behavior.

As mentioned, both the coil body as well as the permanent magnets, the pole plates and the flux plate are respectively secured next to one another in the base body by means of plugging the members, bodies or elements into recesses in the base body. Since this design is to be specifically suitable for switching high currents, it is expedient to design the base body as a housing which encloses the magnetic system both at the bottom side as well as with the four lateral walls so that only a passage for the armature or, respectively for a contact slide actuatable via the armature is left open. Moreover, the bottom side or base is necessarily recessed in the region of the coil so that the entire depth of the base body within an inverted protective cap is available for the coil winding. The contact elements are thereby likewise disposed in the base body but separated from the housing surrounding the magnetic system. To this end, the base body expediently forms a second or additional chamber surrounding the contact elements. This additional chamber comprises lateral slots for the insertion of the contact terminal elements.

The relay possesses at least one stationary contact element and one movable contact element. A changeover contact is also possible as is the provision of more than one contact pair or changeover contact, for example, by means of disposing respectively one contact pair at each side of the magnet system. In this latter instance, a contact actuating slide could, for example, be hinged to the armature with its central part and actuated respectively movable contact elements with its two ends. In an embodiment of the inventive relay, the movable contact element in the form of a contact spring is secured to a rigid terminal element anchored in the base body. The neutral position of such a contact spring can be determined by a detent fashioned in the housing or also by an adjustable continuation of the appertaining terminal element. In another embodiment, the movable contact spring can also be secured to a continuation of the armature. In this case, the contact spring is designed as a contact bridge or is connected to a terminal element via a flexible lead.

In one embodiment of the invention, a contact actuation member is coupled to the free end of the armature, for example, to that end lying opposite to the bearing thereof. The magnet system, however, can also be disposed such that the armature penetrates the flux plate with its seated end and comprises an angle of continuation in extension of this end which indirectly or directly actuates the contact spring.

DESCRIPTION OF THE PREFERRED EMBODIMENTS

Figure 1:
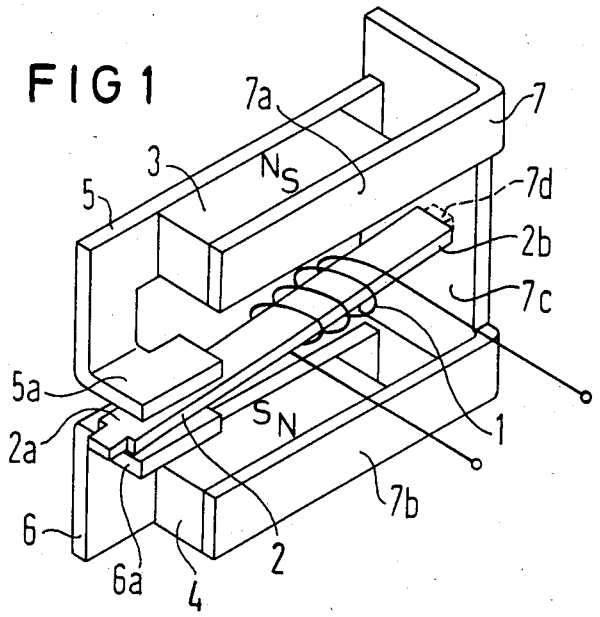
FIG. 1 is a perspective view of a fundamental illustration of the magnet system for the relay in accordance with the present invention.
Figures 2, 3, 4, 5:
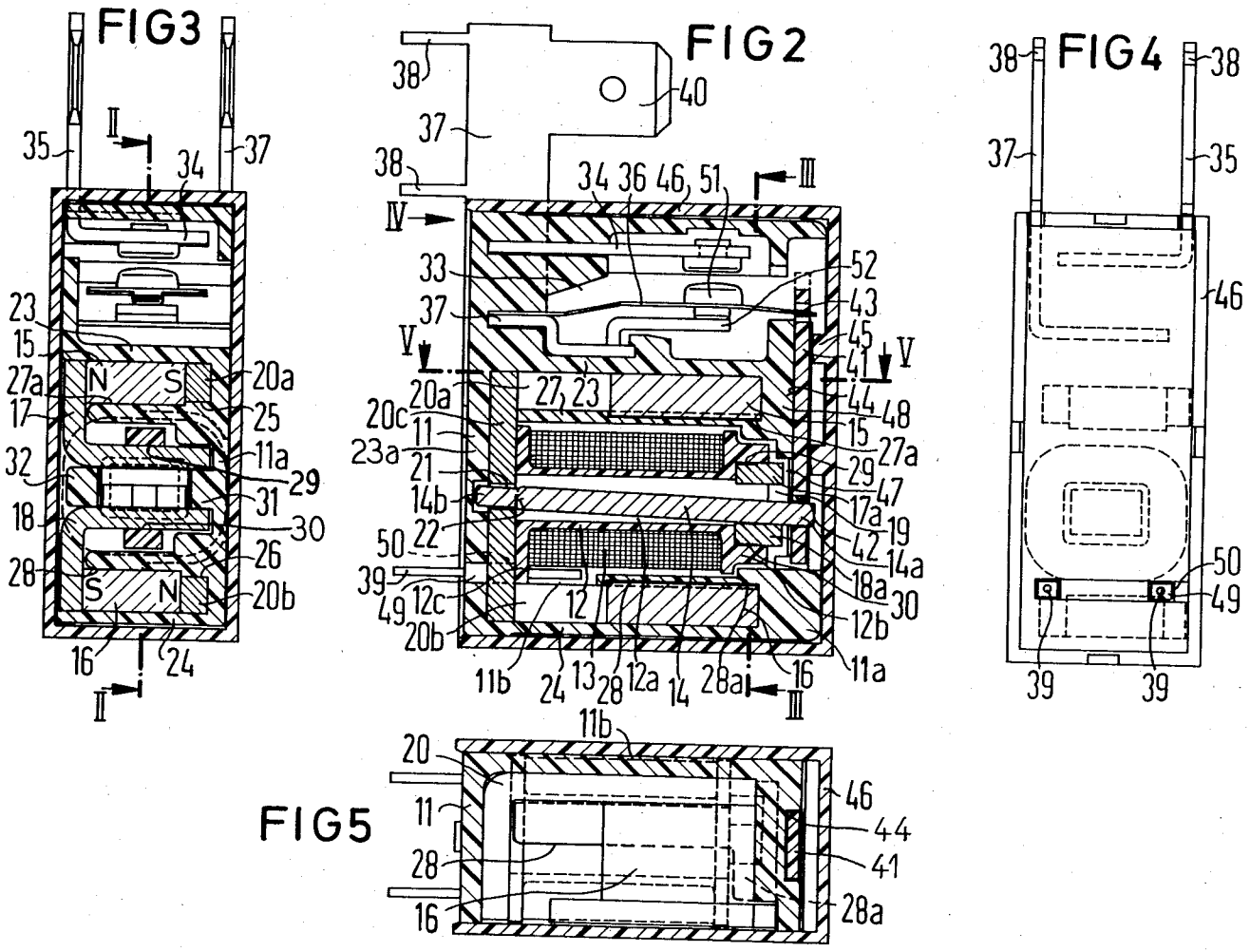
FIG. 2 is a cross-sectional view with portions in elevation taken along line II—II of FIG. 3 of the relay in accordance with the present invention.
FIG. 3 is a cross-sectional view with portions in elevation taken along line III—III of FIG. 2.
FIG. 4 is a side view taken in the direction of arrow IV of FIG. 2.
FIG. 5 is a cross-sectional view taken along line V—V of FIG. 2.
Figure 7:
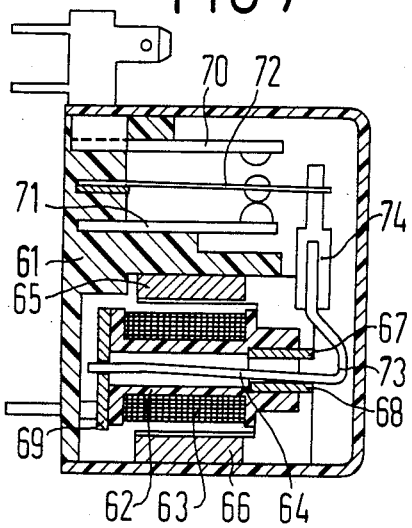
FIG. 7 is a cross-sectional view similar to FIG. 2 of an embodiment of the relay.

The principles of the present invention are particularly useful in a relay such as illustrated in FIG. 2 which utilizes a magnetic system best illustrated in FIG. 1. As illustrated in FIG. 1, an elongated, bar-shaped armature 2 is disposed in a coil 1 that is only schematically illustrated. On both sides of the coil 1 are respective permanent magnets 3 and 4. The magnet 3 is positioned between a pole plate or piece 5 and a narrow section 7*a* of the flux plate 7. In a similar manner, the magnet 4 is positioned between a pole plate or piece 6 and a narrow section 7*b* of the flux plate 7. The two magnets have opposite polarization directions. At their mutual facing edges, the two pole plates 5 and 6 have sections or portions 5*a* and 6*a* which are bent roughly at right angles to a common plane of the plates 5 and 6. As illustrated, these portions 5*a* and 6*a* are angled inwardly down and form mutually opposed pole faces that are parallel to one another. A free end 2*a* of the armature 2 is switchable in a working air gap between the faces of the portions 5*a* and 6*a*. The opposite end 2*b* of the armature 2 is seated in a portion 7*c* of the flux plate 7 which section or portion is perpendicular to the coil axis. As illustrated, the armature end 2*b* is received in a recess or aperture 7*d* so that a good transfer of the magnetic flux between the flux plate 7 and the armature 2 is assured. The permanent magnets 3 and 4 as well as flux plate segments 7*a* and 7*b* are thus disposed at both sides of the coil and are respectively laterally attached to the pole plates 5 and 6, respectively, at the side towards which the pole plate sections 6*a* and 6*b* are also angled. A flat format of the magnetic system or arrangement is thus achieved so that this can be used in a base body in a compact form.

An actual relay in accordance with the present invention is illustrated in FIGS. 2–5. In this relay, a base body 11 has a bottom portion 11*a* which has a recess 11*b* that receives a coil body 12 with a winding 13. The coil body 12 has a spool shape and has an axially extending passage 12*a*, a first end flange 12*c* and a second end flange 12*b*. A bar-shaped armature 14 having ends 14*a* and 14*b* is disposed in the passage 12*a* roughly on the axis of the coil body 12. A permanent magnet 15 is positioned above the coil body 12 and a permanent magnet 16 is positioned below the coil body 12. A pole plate or piece 17 engages one side of the permanent magnet 15 while a pole plate or piece 18 engages one side of the permanent magnet 16 and the two pole pieces basically lie in a common plane which extends parallel to the axis of the coil body 12 (see FIG.3). Each of the pole plates 17 and 18 adjacent one end have sections or portions 17*a* and 18*a* which extend at right angles to the common plane and provide parallel faces on opposite sides of the axis of the coil, which faces surround a free end 14*a* of the armature. Thus, the faces of the sections or portions 17*a* and 18*a* form a working air gap 19 in which the armature is moved back and forth. The pole faces of the two magnets 15 and 16 which are opposite to the pole faces engaged by the plates 17 and 18 are covered with respective sections 20*a* and 20*b* of a flux plate 20 which has a major portion 20*c* that extends perpendicular to the coil axis and which has an opening or recess 21 in which an end 14*b* of the armature 14 is received to form a pivotable mounting of the armature. As illustrated, the armature preferably has shoulders such as 22 adjacent the end 14*b* to limit the movement of the armature into the aperture 21 and to insure good contact between the armature and the flux plate portion 20*c*.

As illustrated in the drawings, the coil body 12 with the windings 13 and the armature 14, the permanent magnets 15 and 16, the pole plates 17, 18 and the flux plate 20 are all surrounded on all sides by lateral wall portions 23, 23*a*, 24 and 44 of the base body 11. As mentioned hereinbefore, these wall portions form a recess 11*b* in the low region 11*a* of the body 11 for receiving the coil body so that the bottom 11*a* of the base body 11 need not be wider than the diameter of the coil winding. In addition, the base body forms respective seating surfaces for the plug-type fastening and positioning of the individual parts. For example, the flux plate 20 has a segment 20*a* received in a recess 25 formed between the lateral wall portions 23 and 23*a*. In a similar manner, the segment 20*b* is received in the recess 26 which is formed between the segment 24 and 23*a* (FIG. 3). These recesses 25 and 26 also receive the permanent magnets and the recess 25 is spaced from the recess 11*b* by a wall or portion 27 while the recess 11*b* is spaced from the recess 26 by a wall portion such as 28. The wall portion 27 has a recess 27*a* which helps receive and hold the magnet 15 in the desired position and the wall portion 28 (FIG. 2) has a recess 28*a* for receiving and holding the magnet 16 in the desired position. The pole plates 17 and 18 are likewise laterally supported against the walls 23 and 24 whereas their angled sections 17*a* and 18*a* lie between the seating surfaces 29 and 30 of the second flange 12*b* and are supported at the inside by a nose-like elevation or projection 31 of the base body 11 as well as the nose or portion 32 on the coil body 12 (see FIG. 3). Thus, each of these parts is plugged into its position in the base body 11 and the desired air gap is defined.

The wall portion or partition 23 also forms an insulation between the magnetic system or arrangement and a contact chamber 33 in an upper portion of the base body 11. In the contact chamber 33, a stationary contact element element such as 34 with a terminal element 35 as well as a contact spring element 36 with a terminal element 37 are mounted. The two contact terminals 35 and 37 are secured by being plugged into grooves or recesses on the coil body 11 from opposite sides. They form respective terminal pins 38 in the grid with the coil terminal pins 39 as well as plug receptacle terminals (fast-on plugs) such as 40 (FIG. 2). The contact element 36 is actuated by a slide 41 which has a recess or aperture 42 that is received on the free end 14*a* of the armature. The free end of the contact spring 36 is received in an aperture opening 43 at the opposite end of the slide 41. The slide 41 slides along a glide face of a channel 44 (FIG. 5) which is formed in the end of the body 11. The slide is secured in the channel 44 by a pair of projections 45 which are provided on an inner surface of a protective cap 46 of insulating material that is slipped over the body 11. Due to utilizing insulating material for both the body 11 and the cap 46, a large insulating path can be obtained between the magnet system in the lower portion of the body and the contact elements which are in the upper portion with only a passage 47 for the armature which passage is formed in a side wall 48 of the base body 11.

The assembly of the various parts of the relay is obtained in a simple fashion by means of a plug-in technique. First of all, the wound coil body 12 is assembled with the flux plate 20 whereby insulated bushings 49 of the terminal pins 39 extend through a recess or slots 50 of the flux plate section or portion 20*c*. Subsequently, the flux plate with the coil body is inserted into the base body 11 and the permanent magnets 15 and 16 as well as the pole plates 17 and 18 are then assembled in the respective recesses by a plug-in manner. The terminal element 35 with contact element 34 is likewise introduced from the same side whereas the contact terminal 37 is introduced into and secured in the base body from an opposite side. The armature 14 is introduced into the passage 12*a* of the coil body with its fixed end assembled with the flux plate portion 20*c*. Then the contact slide 41 is plugged onto the armature and onto the contact spring 36. The parts are secured in the insulated base body 11 by means of assembling the protective cap 46 thereon.

As shown in FIG. 2, the contact 51 of the movable contact spring 36 rests on a seat 52 when in a neutral condition. This seat 52 has been designed by a crimped extension of the terminal element 37. The neutral position of the contact spring can be adjusted by means of bending this seat 52.

Figure 6:
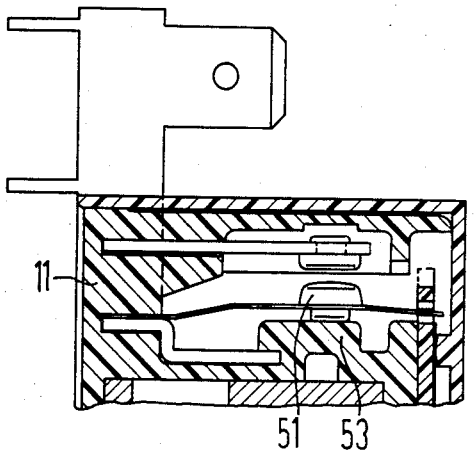
FIG. 6 is a partial cross-sectional view similar to FIG. 2 of a modification or embodiment of the contacts in accordance with the present invention.

In an embodiment or modification illustrated in FIG. 6, the contact 51 is supported against a detent or rib 53 which is formed in the insulating material of the body 11. Otherwise, the relay illustrated in FIG. 6 is exactly like the relays of FIGS. 2–5.

In FIGS. 7–10, four modifications or embodiments of the relay of the present invention are illustrated. For example, in FIG. 7, a relay has a base body 61 for receiving a coil body 62 with a winding 63. An armature 64 as well as permanent magnets 65 and 66 are positioned with the armature 64 extending into the passage of the coil body and the magnets being on opposite sides thereof. Pole plates 67 and 68 are disposed as described above as well as the flux plate 69. Two stationary contact elements 70 and 71 are mounted in the body 61 with a movable contact element or contact spring 72 anchored therebetween. To actuate the movable contact, the armature 64 has a bent or crimped continuation 73 on which a slide or element 74 of insulating material has been formed or extruded thereon. Thus, actuation of the relay from the position illustrated to an upper position causes the movable contact 72 to move from contact with the stationary contact 71 to the stationary contact 70.

Figure 8:
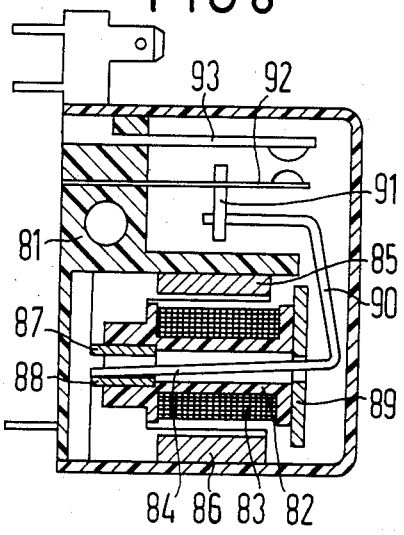
FIG. 8 is a cross-sectional view similar to FIG. 2 of another embodiment of the present invention.

In the embodiment illustrated in FIG. 8, the relay has a base body 81, a coil body 82 with a winding 83, an armature 84 and permanent magnets 85 and 86. Two pole plates 87 and 88 as well as a flux plate 89 are disposed in the base body 81 but are disposed at the opposite ends from the positions illustrated in FIG. 7. In a fashion similar to that above, the armature 84 is seated in a passage in the flux plate 89, however, the armature has a portion that extends past the seated end and is provided with an angled or bent continuation 90 which has a portion extending parallel to the armature and then has a U shape. The end of the continuation is connected by a slide 91 of insulating material to the movable contact spring 92. A stationary contact element 93 is anchored in the base body 81 with its terminal element as is the terminal element for the contact spring or element 92.

Figure 9:
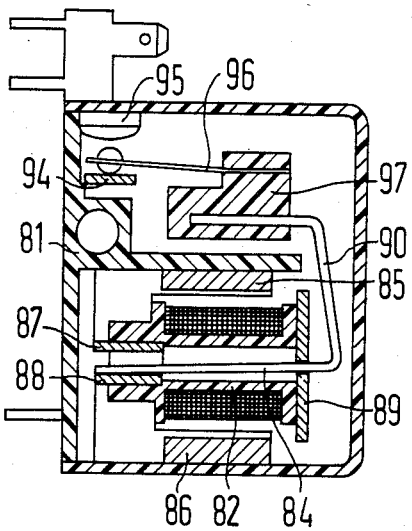
FIG. 9 is a cross-sectional view of a still further embodiment in accordance with the present invention.

Another embodiment of the relay is illustrated in FIG. 9. In this embodiment, which is similar to the embodiment of FIG. 8, the two stationary contact elements 94 and 95 are anchored in the base body 81 and a movable contact spring or element 96 is switchable therebetween. This movable contact spring 96 is rigidly connected to an armature continuation 90 by an insulating block 97 so that it is a loosely mobile slide and any friction is eliminated. It should be noted that the electrical contact to the movable contact spring 97 is attained via a wire which extends into the relay.

Figure 10:
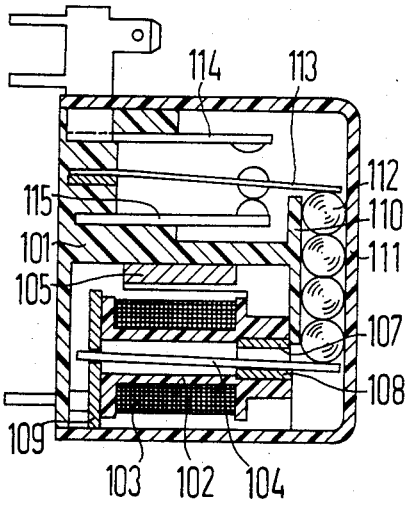
FIG. 10 is a cross-sectional view similar to FIG. 2 of yet another embodiment of the present invention.

A final embodiment is shown in FIG. 10. In this embodiment, a magnetic system with a coil body 102 with a winding 103 and an armature 104 is shown as being disposed in a base body 101. In addition, a permanent magnet 105 is disposed at one side of the coil body whereas the two pole plates 107 and 108 as well as a flux plate 109 are symmetrically provided in accordance with the preceding illustrative embodiments. The base body 101 has a guide strip 110 which forms a guide channel with the protective cap 111. Balls 112 for contact actuation are movably arranged in this guide channel. These balls 112 consist of insulating material and are dimensioned in sizes and numbers such that they precisely fill out the distance between the armature 104 and a contact spring 113 in order to switch this contact spring between the two cooperating contact elements 114 and 115. The actuation balls 112 can, for example, by provided in two slightly different sizes so that a different combination and thus different actuation units can be formed by means of corresponding selection from these two sizes. Thus, during the assembly of the relay, a precise distance between the armature 104 and the contact spring 113 is first determined and the required combination of balls with slightly different diameters is correspondingly selected. As mentioned hereinabove, due to the presence of only a single permanent magnet 105, the pole piece such as 108 is ferromagnetically connected to the flux plate 109.

Although various minor modifications may be suggested by those versed in the art, it should be understood that I wish to embody within the scope of the patent granted hereon, all such modifications as reasonably and properly come within the scope of my contribution to the art.

I claim:

1. In a polarized relay having a base body; a coil being secured in the base body and having a coil body with an axially extending passage, first and second end flanges and a winding on the coil body between the flanges; a bar-shaped armature being received inside the passage of the coil body on an axis thereof and being pivotally mounted adjacent the first flange to enable pivotal movement thereof; a permanent magnet arrangement having two pole plates which are on a common plane extending parallel to the coil axis, each pole plate adjacent the second flange having end portions extending at right angles to the common plane to provide spaced surfaces having an air gap for a free end of the armature to extend into said magnet arrangement including a flux plate having a portion extending perpendicular to the coil axis and having a segment extending parallel to the pole plates and coacting with the pole plates to form a space for receiving each magnet of the arrangement; at least one stationary contact element anchored in the base body and at least one movable contact element being moved by that armature between a position out of engagement with the associated stationary contact and a position engaging the stationary contact; the improvements comprising actuating means for transferring movement of the armature to the movable contact element, said magnet arrangement having a portion on both sides of the coil, each portion of the arrangement including one pole plate and a narrow segment of the flux plate extending parallel thereto to form a space for receiving a double pole permanent magnet, at least one permanent magnet being provided in one of the two spaces, said armature being mounted for pivotal movement in a recess in the portion of the flux plate and wherein said base body has recesses and slots for receiving each of the parts of the relay including the coil body, the contact elements, said flux plate, each permanent magnet and the two pole plates so that the parts of the relay are assembled by being plugged into the base body.

2. In a polarized relay according to claim 1, wherein a permanent magnet is disposed in each of the two spaces on both sides of the coil.

3. In a polarized relay according to claim 1, wherein only one permanent magnet is provided in one of the two spaces and the pole plate and segment of the flux plate forming the other space are ferromagnetically interconnected.

4. In a polarized relay according to claim 1, wherein the base body in a bottom part has a recess for receiving the coil, said recess having wall portions on five sides with the open side extending away from the contact elements and one of the wall portions having an aperture to enable the armature to extend therethrough.

5. In a polarized relay according to claim 4, wherein the opening in the one wall portion faces away from the contact element.

6. In a polarized relay according to claim 1, wherein the actuating means for transferring movement of the armature to the contact spring includes a card-shaped member having an aperture engaging the armature and another aperture for engaging each contact spring element of the relay.

7. In a polarized relay according to claim 6, wherein the base body is received in a protective cover, said slide member being guided along a surface of a wall portion of the base body, and being held on said surface by projections provided on said protective cover.

8. In a polarized relay according to claim 6, wherein said base body has an integral seating rib for defining a neutral position of the movable contact spring.

9. In a polarized relay according to claim 6, wherein a terminal element for the movable contact spring includes an adjustable seat to define a neutral position of the movable contact spring in the base body.

10. In a polarized relay according to claim 1, wherein the recesses for receiving the coil body, pole plates, permanent magnets and flux plate open to one side with the plug-in direction being perpendicular to the axis of the coil, and said relay includes a protective cap receiving the base body and enclosing said recesses after insertion of the parts.

11. In a polarized relay according to claim 1, wherein the recess in the flux plate is an aperture, wherein said actuating means includes an extension of the armature extending through said aperture and being curved upward toward said contact to form a contact actuation leg.

12. In a polarized relay according to claim 11, wherein said contact actuation leg is bent in the direction parallel to the armature and is provided with an insulating member.

13. In a polarized relay according to claim 12, wherein the movable contact element is mounted in said insulating member.

14. In a polarized relay according to claim 12, wherein the movable contact is mounted in the base body and said insulating member connects the actuation leg to said movable contact member.

15. In a polarized relay according to claim 1, wherein a protective cap is inserted over the base body, said protective cap and a wall of said base body forming a guide channel, said actuating means including at least one actuation element being fitted in said guide channel between the end of the armature and the contact spring.

16. In a polarized relay according to claim 15, wherein the actuation elements include balls formed of insulating material.

17. In a polarized relay according to claim 16, wherein said balls have different diameters.

18. In a polarized relay according to claim 1, wherein said actuating means includes an extension of the armature extending beyond the air gap formed by the end portions of the pole plates, said extension being bent toward the movable contact and terminating in a connecting member formed of insulating material.

19. In a polarized relay according to claim 1, wherein a permanent magnet is disposed in each of said spaces, said relay including a protective cap receiving the base body and closing the recesses in which the pole plates, permanent magnets, flux plate and coil body were inserted, said protective cap coacting with the base body to insulate the magnet arrangement and coil from the contacts except for an opening through which the free end of the armature extends.

20. In a polarized relay according to claim 19, wherein the actuating means contact a channel formed in the end wall of the base body, a slide received in said channel having an aperture surrounding the free end of the armature and means spaced from the armature for engaging the movable contact, said slide being held in said groove by ribs formed on the protective cap.

* * * * *